US010288377B2

(12) United States Patent
Stephenson

(10) Patent No.: US 10,288,377 B2
(45) Date of Patent: May 14, 2019

(54) ALIGNMENT AID

(71) Applicant: Allen Daniel Stephenson, Greenville, SC (US)

(72) Inventor: Allen Daniel Stephenson, Greenville, SC (US)

( * ) Notice: Subject to any disclaimer, the term of this patent is extended or adjusted under 35 U.S.C. 154(b) by 39 days.

(21) Appl. No.: 15/599,089

(22) Filed: May 18, 2017

(65) Prior Publication Data

US 2018/0335277 A1 Nov. 22, 2018

(51) Int. Cl.
*F41G 1/02* (2006.01)

(52) U.S. Cl.
CPC ..... *F41G 1/02* (2013.01)

(58) Field of Classification Search
CPC ... F41G 1/54; F41G 1/473; F41G 1/02; F41G 1/01; F41G 1/42
USPC ..... 42/142, 140, 111, 141, 134, 133
See application file for complete search history.

(56) References Cited

U.S. PATENT DOCUMENTS 1,718,458 A * 6/1929 Hager ..... F41G 1/425 42/144
2,056,469 A * 10/1936 King ..... F41G 1/473 42/140
2,904,888 A * 9/1959 Niesp ..... F41G 1/473 42/141
3,834,035 A * 9/1974 Merrill ..... F41G 1/08 42/133
4,244,114 A * 1/1981 Strahan ..... F41G 1/425 42/137
6,418,633 B1 * 7/2002 Rager ..... F41G 1/467 124/87
8,919,027 B2 * 12/2014 Curry ..... F41G 1/00 42/133

* cited by examiner

*Primary Examiner* — Reginald S Tillman, Jr.
(74) *Attorney, Agent, or Firm* — Steve LeBlanc, LLC

(57) ABSTRACT

An alignment aid that includes a surface that defines a plane. First, second, and third references are aligned along a first axis of the surface, wherein each reference has a length along the first axis and a width along a second axis orthogonal to the first axis. A distance is between adjacent references along the first axis. Each reference includes a first alignment feature adjacent to a second alignment feature. Each first alignment feature has a first alignment feature elevation orthogonal to the first and second axes. Each second alignment feature has a second alignment feature elevation orthogonal to the first and second axes. For each reference, the first alignment feature elevation is higher than the second alignment feature elevation.

20 Claims, 9 Drawing Sheets

ALIGNMENT AID

FIELD OF THE INVENTION

The present invention generally involves an alignment aid that may be used to aim an object at a desired target.

BACKGROUND OF THE INVENTION

Many tools and other objects require an operator to position or aim the tool in a desired direction or at a desired target during use. For example, an operator must point and aim a pointer, laser, bow and arrow, hand gun, shot gun, rifle, or other weapon at a desired target during use. The particular direction of aim depends solely on the relative location of the target with respect to the operator and may generally be described as the line of sight between the operator and the target. For example, the operator looks at the target and then positions or aims the tool or object to point along the operator's line of sight to the target.

In many cases, the tool or object includes an alignment aid that assists the operator to quickly and accurately aim the tool or object. For example, weapons often include a set of front and rear sights that allow the operator to aim the weapon at the target by visually lining up the front and rear sights along the line of sight to the target. Although front and rear sights provide a geometrically accurate solution for aligning the weapon to the target along the line of sight, the sights also necessarily require the operator to place the weapon directly in the operator's line of sight to the target which may undesirably obscure the operator's view of the target. In addition, the physical task of visually lining up the target with the front and rear sights takes time and coordination that may not exist during a crisis that requires immediate response to a moving or stationary target. Moreover, the front and rear sights generally protrude from the weapon, creating snag points that reduce the mobility of the weapon and which may require periodic alignment to confirm they are properly aligned.

Therefore, the need exists for an improved alignment aid that may be temporarily or permanently fixed to a tool or object to facilitate efficient and accurate aiming of the tool or object at a desired target.

BRIEF DESCRIPTION OF THE INVENTION

Aspects and advantages of the invention are set forth below in the following description, or may be obvious from the description, or may be learned through practice of the invention.

One embodiment of the present invention is an alignment aid that includes a surface that defines a plane. First, second, and third references are aligned along a first axis of the surface, wherein each reference has a length along the first axis and a width along a second axis orthogonal to the first axis. A distance is between adjacent references along the first axis. Each reference includes a first alignment feature adjacent to a second alignment feature. Each first alignment feature has a first alignment feature elevation orthogonal to the first and second axes. Each second alignment feature has a second alignment feature elevation orthogonal to the first and second axes. For each reference, the first alignment feature elevation is higher than the second alignment feature elevation.

An alternate embodiment of the present invention is an alignment aid that includes a surface that defines a plane. First, second, and third references are aligned along a first axis of the surface, wherein each reference has a length along the first axis and a width along a second axis orthogonal to the first axis. A distance is between adjacent references along the first axis. Each reference includes a first projection adjacent to a second projection. Each first projection has a first projection elevation orthogonal to the first and second axes. Each second projection has a second projection elevation orthogonal to the first and second axes. For each reference, the first projection elevation is higher than the second projection elevation.

In yet another embodiment of the present invention, an alignment aid includes first, second, and third references aligned along a first axis, wherein each reference has a length along the first axis and a width along a second axis orthogonal to the first axis. A distance is between adjacent references along the first axis. Each reference includes a first alignment feature adjacent to a second alignment feature. The first alignment features define a planar surface and the second alignment features are below the planar surface.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
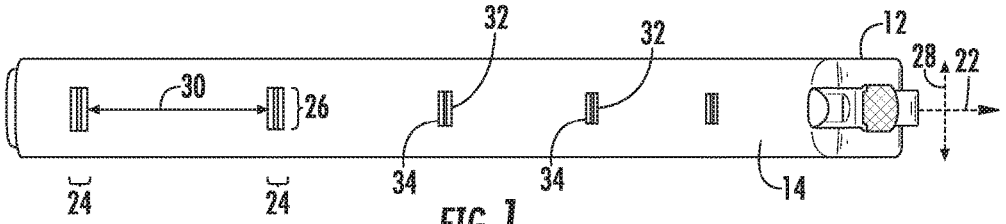
FIG. 1 is a top plan view of an embodiment of the present invention installed on the top surface of a hand gun.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, the phrase "vanishing property of perspective" refers to the optical illusion in which evenly spaced, identical objects appear narrower and closer together as the distance from a viewer increases. For example, a conventional railroad track includes evenly spaced, identical width railroad ties that extend between parallel rails. When looking along a long length of railroad track, the width of the ties, the distance between adjacent ties, and the distance between the parallel rails each appears to decrease as the distance from the viewer increases, ultimately converging to a vanishing point.

Embodiments of the present invention may offset or reverse the vanishing property of perspective to provide an alignment aid 10 that may be used to aim an object 12 at a desired target. The alignment aid 10 may be a template, a plate, or any other suitable material that may be temporarily or permanently attached to the object 12. Alternately, the alignment aid 10 may be integrally incorporated into the manufacture of the object 12 itself, such as through molding, forging, casting, etching, or other suitable manufacturing techniques. For illustrative purposes, embodiments of the present invention will be illustrated in the context of an alignment aid 10 for a hand gun 12, shot gun, or rifle. However, the present invention is not limited to any particular object unless recited in the claims, and embodiments of the present invention may be suitably adapted for use with a pointer, laser, bow and arrow, or virtually any object that would benefit from faster, easier, and/or more accurate alignment with a desired target.

Figure 2:
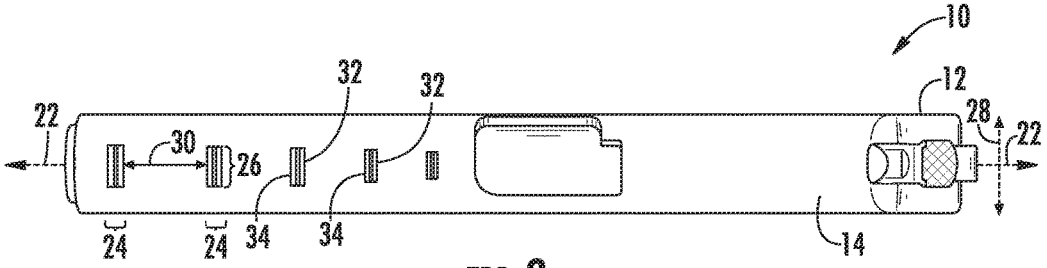
FIG. 2 is a top plan view of the embodiment shown in FIG. 1 installed on the top surface of a different-sized hand gun.
Figure 3:
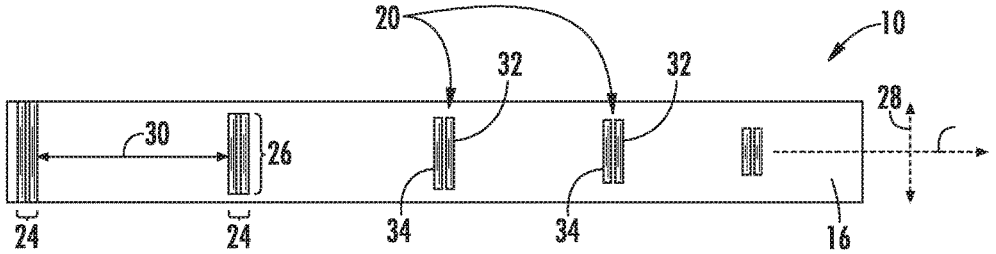
FIG. 3 is a top plan view of the embodiment shown in FIG. 1.
Figure 4:
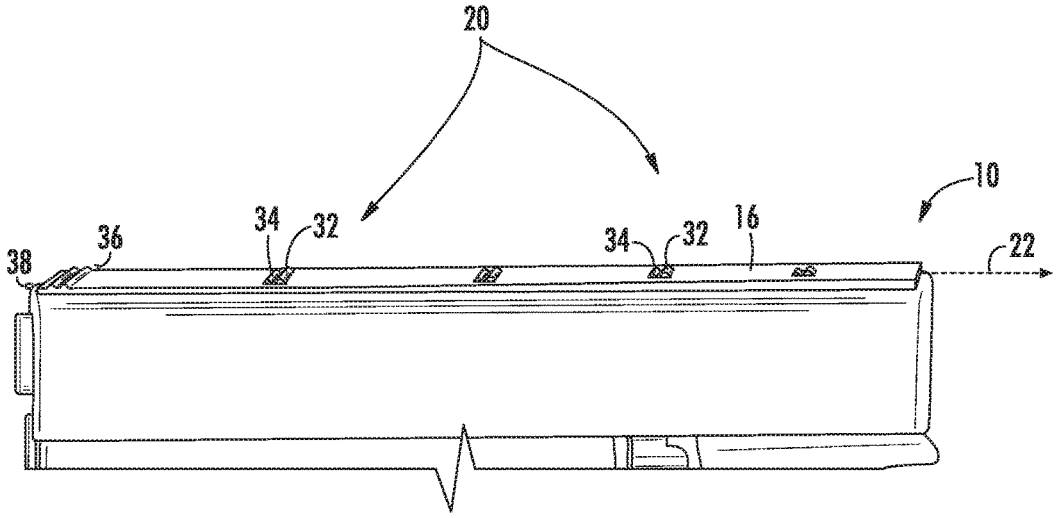
FIG. 4 is a side perspective view of the embodiment shown in FIG. 3.
Figure 5:
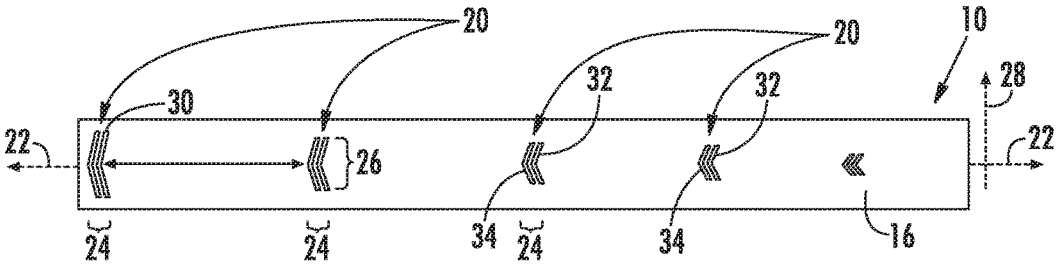
FIG. 5 is a top plan view of a second embodiment of the present invention.

FIGS. 1 and 2 provide top plan views of an alignment aid 10 according to one embodiment of the present invention installed on a hand gun 12. FIG. 3 provides a top plan view, and FIG. 4 provides a side perspective view of the alignment aid 10 shown in FIG. 1 without the hand gun 12. FIG. 5 provides a top plan view of the alignment aid 10 according to a second embodiment of the present invention. As shown in FIGS. 1 and 2, the alignment aid 10 is sized to fit on a top surface 14 of the object 12 so the alignment aid 10 is easily visible to the operator during use of the object 12. As shown in FIGS. 1-5, the alignment aid 10 generally includes a surface 16 that defines a plane with a plurality of references 20 generally aligned along a first axis 22 of the surface 16. The number of references 20 will vary according to the particular dimensions of the object 12. For example, smaller objects 12 with limited surface area on the top surface 14 may only accommodate two or three references 20 aligned along the first axis 22. Larger objects, such as a shot gun or rifle with substantially larger surface area on the top surface 14 may readily accommodate 5, 10, or more references 20 aligned along the first axis 22.

As shown most clearly in FIGS. 3 and 5, each reference 20 has a length 24 parallel to the first axis 22 and a width 26 along a second axis 28 orthogonal to the first axis 22. The length 24, width 26, and/or spacing 30 between adjacent references 20 may increase along the first axis 22 to offset or reverse the vanishing property of perspective to provide an operator with a natural perspective or quick reference to ensure that the object 12 is aligned with the line of sight to the intended target. For example, in the particular embodiment shown in FIGS. 1-5, the references 20 progressively increase in length 24, width 26, and spacing 30 from right to left. The increase in length 24, width 26, and spacing 30 between adjacent references 20 may be between 10% and 40% or more, depending on the size and length of the alignment aid 10. For example, adjacent references 20 may have an increase in length 24, width 26, and/or spacing 30 of 20% compared to the next adjacent references 20. However, particular embodiments are not limited to any specific increase in length 24, width 26, or spacing 30 unless specifically recited in the claims.

Each reference 20 includes a first alignment feature 32 adjacent to a second alignment feature 34. The first and second alignment features 32, 34 may be any shape or outline of any shape. In addition, the first and/or second alignment features 32, 34 may be painted or colored to optically contrast with each other and the surface 16 of the alignment aid 10 to enhance visibility of the references 20 without creating any snag points that would interfere with smooth storage and retrieval of the object 12.

In the embodiments shown in FIGS. 1-5, the first and second alignment features 32, 34 are projections that extend vertically above the surface 16 of the alignment aid 10. In this manner, each first alignment feature 32 has a first alignment feature elevation 36 orthogonal to the first and second axes 22, 28, and each second alignment feature 34 has a second alignment feature elevation 38 orthogonal to the first and second axes 22, 28. As shown most clearly in FIG. 4, for each reference 20, the first alignment feature elevation 36 is higher than the second alignment feature elevation 38. This difference in elevation causes the first alignment feature 32 to visually eclipse or hide the second alignment feature 34 when viewing the alignment aid 10 from the right end of the first axis 22 as shown in FIGS. 1-5 and the object 12 is aimed too low.

Figure 6:
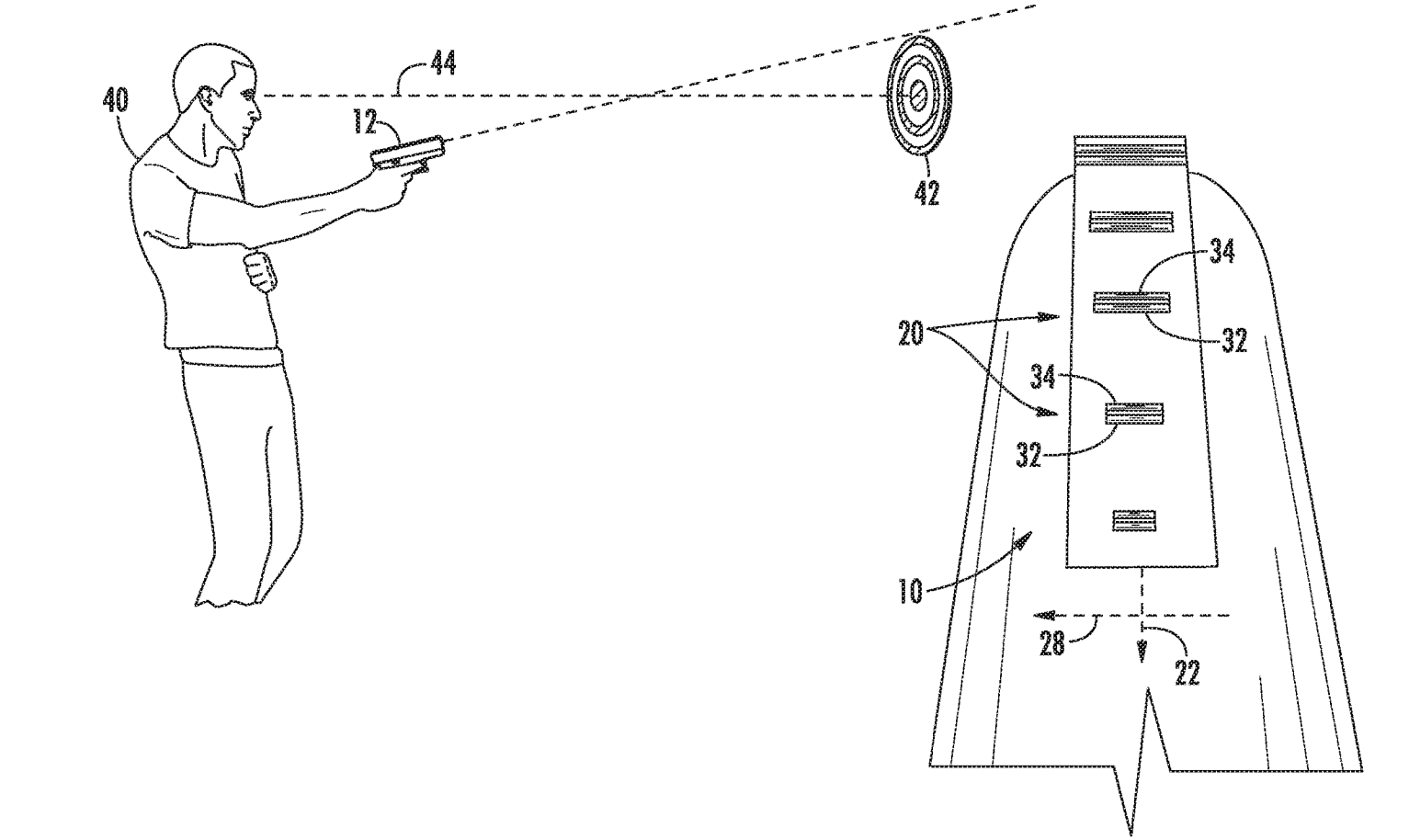
FIG. 6 illustrates the embodiment shown in FIGS. 1-4 being aimed too high at a target.
Figure 7:
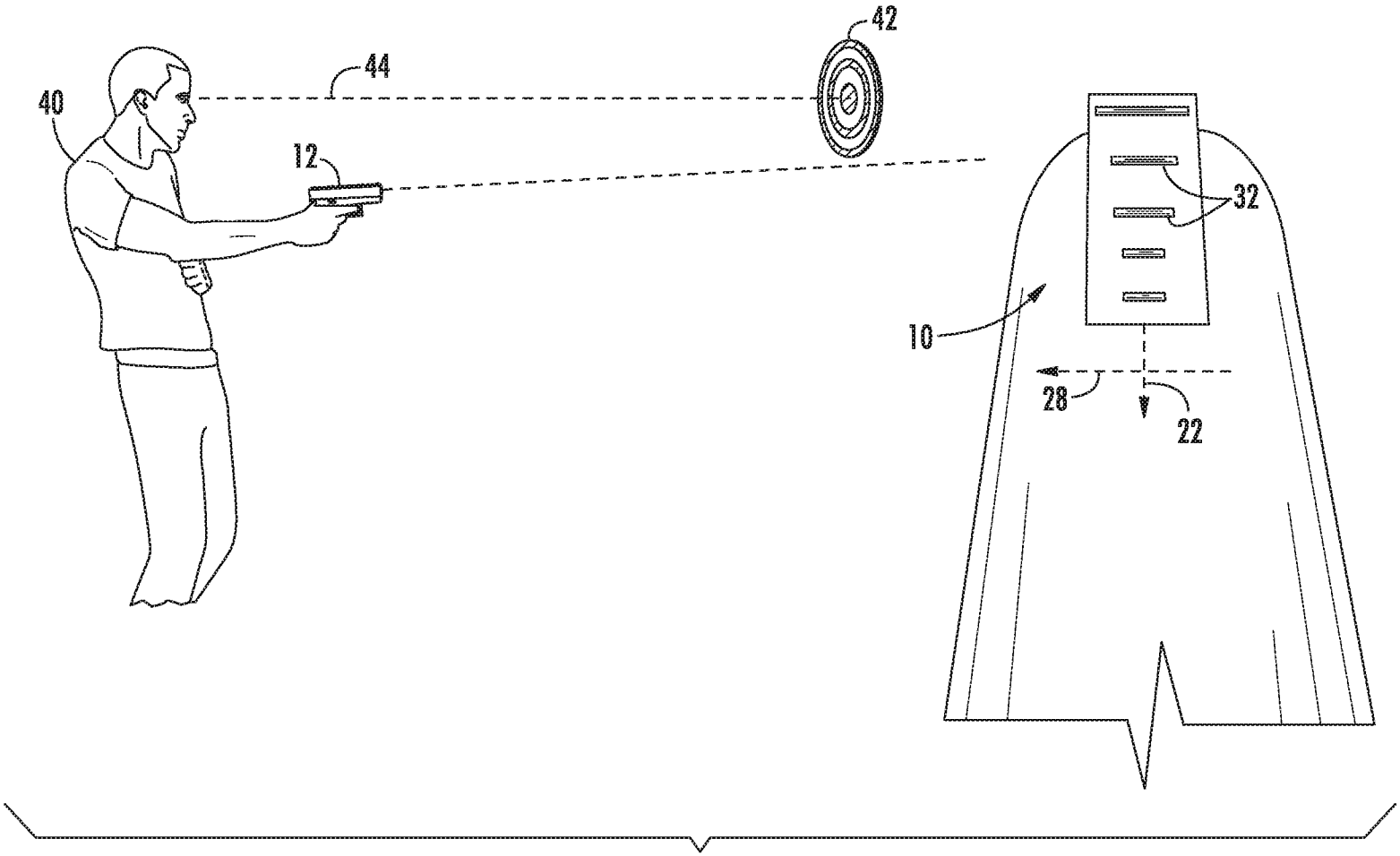
FIG. 7 illustrates the embodiment shown in FIGS. 1-4 being aimed too low at a target.
Figure 8:
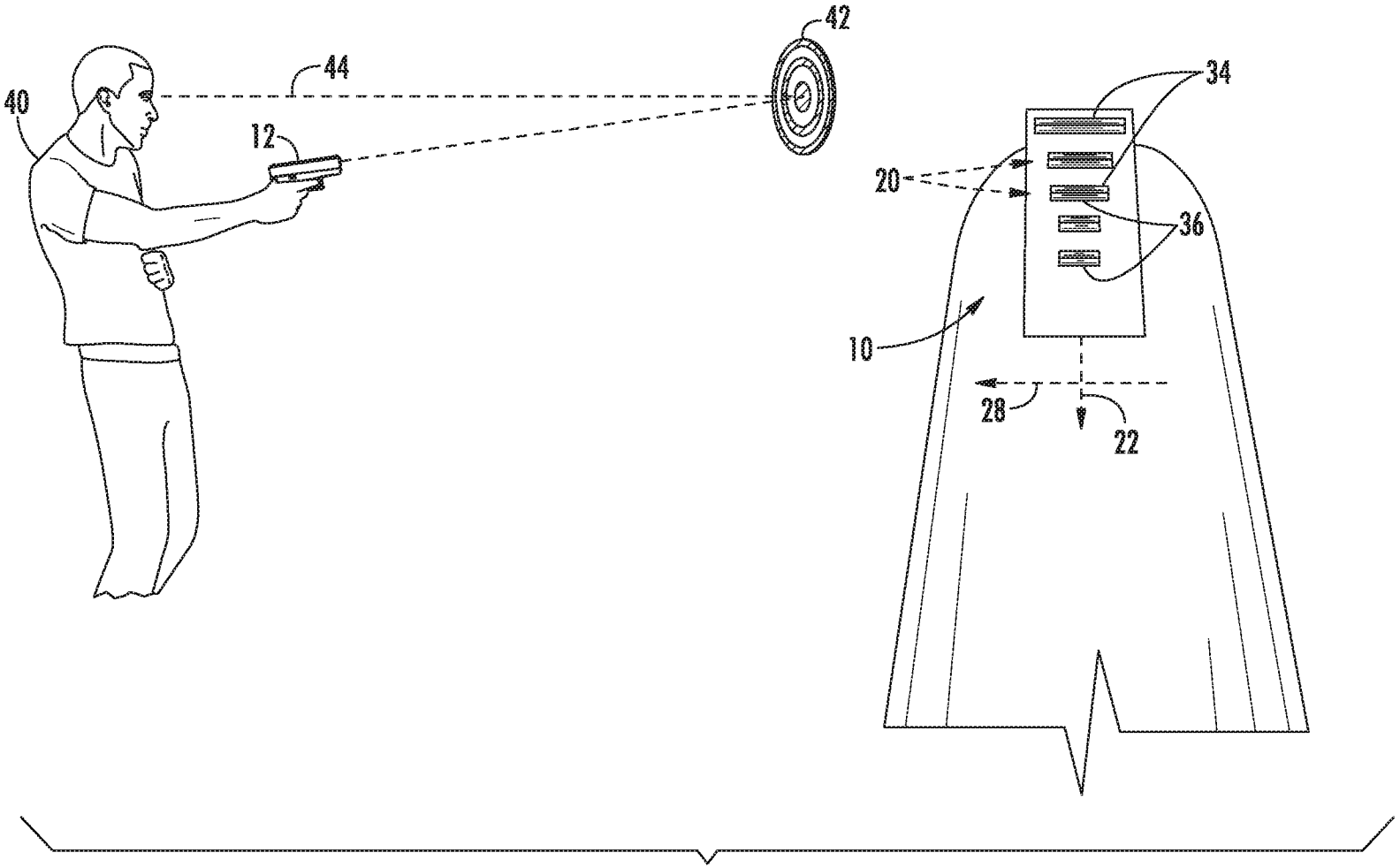
FIG. 8 illustrates the embodiment shown in FIGS. 1-4 being aimed correctly at a target.

FIGS. 6-8 illustrate the use of the alignment aid 10 shown in FIGS. 1-4. As shown on the left side of each figure, an operator 40 extends the object 12 away from the operator 40 and toward a target 42 at an elevation slightly below the line of sight 44 from the operator 40 to the target 42. In this position, the alignment aid 10 is between the operator 40 and the target 42 and slightly below the line of sight 44 between the operator 40 and the target 42. As a result, the operator 40 is able to directly view the target 42 while also being able to peripherally view the alignment aid 10 from the right end of the first axis 22 as shown in FIGS. 1-5. From this axial perspective of the alignment aid 10, the operator 40 may conveniently and reliably determine if the object 12 is accurately pointed at the target 42 based on the appearance of the references 20, as shown on the right side of FIGS. 6-8.

If the operator 40 is aiming the object 12 too high, as shown on the left side of FIG. 6, then the references 20 closer to the operator 40 will appear narrower and closer together than the references 20 further from the operator 40, as shown on the right side of FIG. 6. If the operator 40 is aiming the object 12 too low, as shown on the left side of FIG. 7, then the references 20 will appear to have a consistent length 24, width 26, and spacing 30 due to the vanishing property of perspective optical illusion, but the first alignment features 32 will eclipse or hide the second alignment features 34 from view, as shown on the right side of FIG. 7. If the operator 40 is aiming the object 12 correctly at the target 42, as shown in the left side of FIG. 8, then the references 20 will appear to have a consistent length 24, width 26, and spacing 30 due to the vanishing property of perspective optical illusion. In addition, each second alignment feature 34 will be readily visible directly above its corresponding first alignment feature 32, as shown on the right side of FIG. 8. In this manner, the alignment aid 10 provides the operator 40 with a convenient and reliable aid to quickly and accurately aim the object 12 at the target 42.

Figure 9:
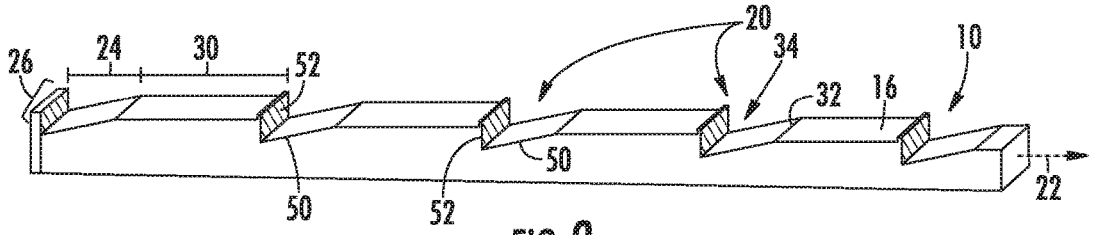
FIG. 9 is a side perspective view of a third embodiment of the present invention.

FIG. 9 provides a side perspective view of a third embodiment of the present invention. As shown in FIG. 9, the alignment aid 10 again includes a plurality of references 20 aligned along the first axis 22, as previously described. Specifically, the length 24, width 26, and spacing 30 for each reference 20 may increase along the first axis 22. In addition, each reference 20 includes first and second alignment features 32, 34. In this particular embodiment, however, the first alignment features 32 essentially define the planar surface 16 of the alignment aid 10, and the adjacent second alignment features 34 include a depression 50 in the surface 16 with an optical contrast 52 that extends vertically in the depression 50 to just below the planar surface 16. The optical contrast 52 my include luminescence, bright colors, or other optical feature to provide a visually discernible difference in appearance from the adjacent first alignment feature 34. In this manner, each first alignment feature elevation 36 is higher than the adjacent second alignment feature elevation 38. As a result, the optical contrast 52 of the second alignment features 34 will be readily visible when the alignment aid 10 is properly aimed, but the first alignment features 32 or planar surface 16 will eclipse or hide the optical contrasts 52 of the second alignment features 34 when the alignment aid 20 is aimed too low.

Figure 10:
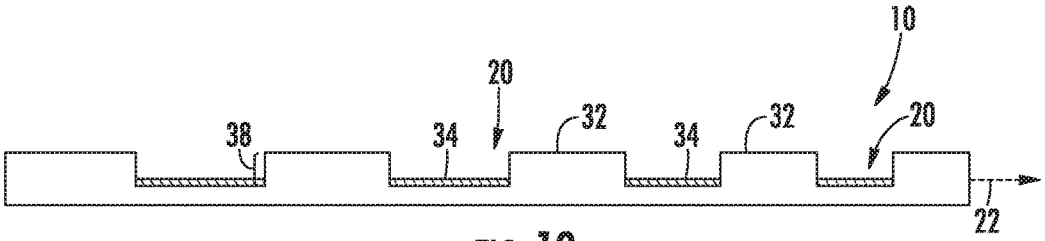
FIG. 10 is a side plan view of a fourth embodiment of the present invention.
Figure 11:
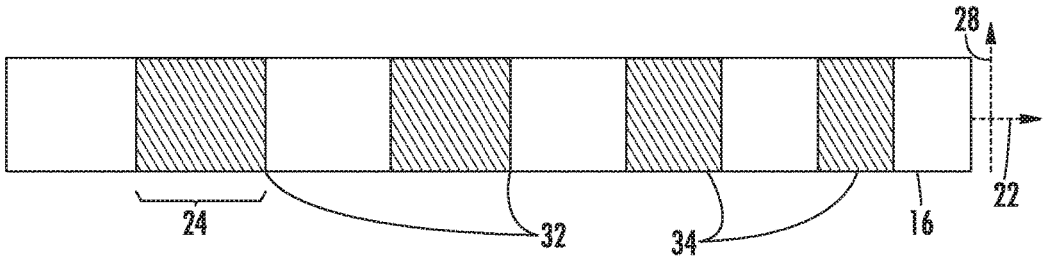
FIG. 11 is a top plan view of the embodiment shown in FIG. 10.

FIG. 10 provides a side plan view and FIG. 11 provides a top plan view of a fourth embodiment of the present invention. As shown in FIGS. 10 and 11, the alignment aid 10 again includes a plurality of references 20 aligned along the first axis 22, as previously described. Specifically, the length 24, width 26, and spacing 30 for each reference 20 may increase along the first axis 22. In addition, each reference 20 includes first and second alignment features 32, 34. As with the embodiment shown in FIG. 9, the first alignment features 32 essentially define the planar surface 16 of the alignment aid 10, and the adjacent second alignment features 34 provide an optical contrast below the planar surface 16. In this manner, each first alignment feature elevation 36 is again higher than the adjacent second alignment feature elevation 38. As a result, the second alignment features 34 will be readily visible when the alignment aid 10 is properly aimed, but the first alignment features 32 or planar surface 16 will eclipse or hide the second alignment features 34 when the alignment aid 20 is aimed too low.

Figure 12:
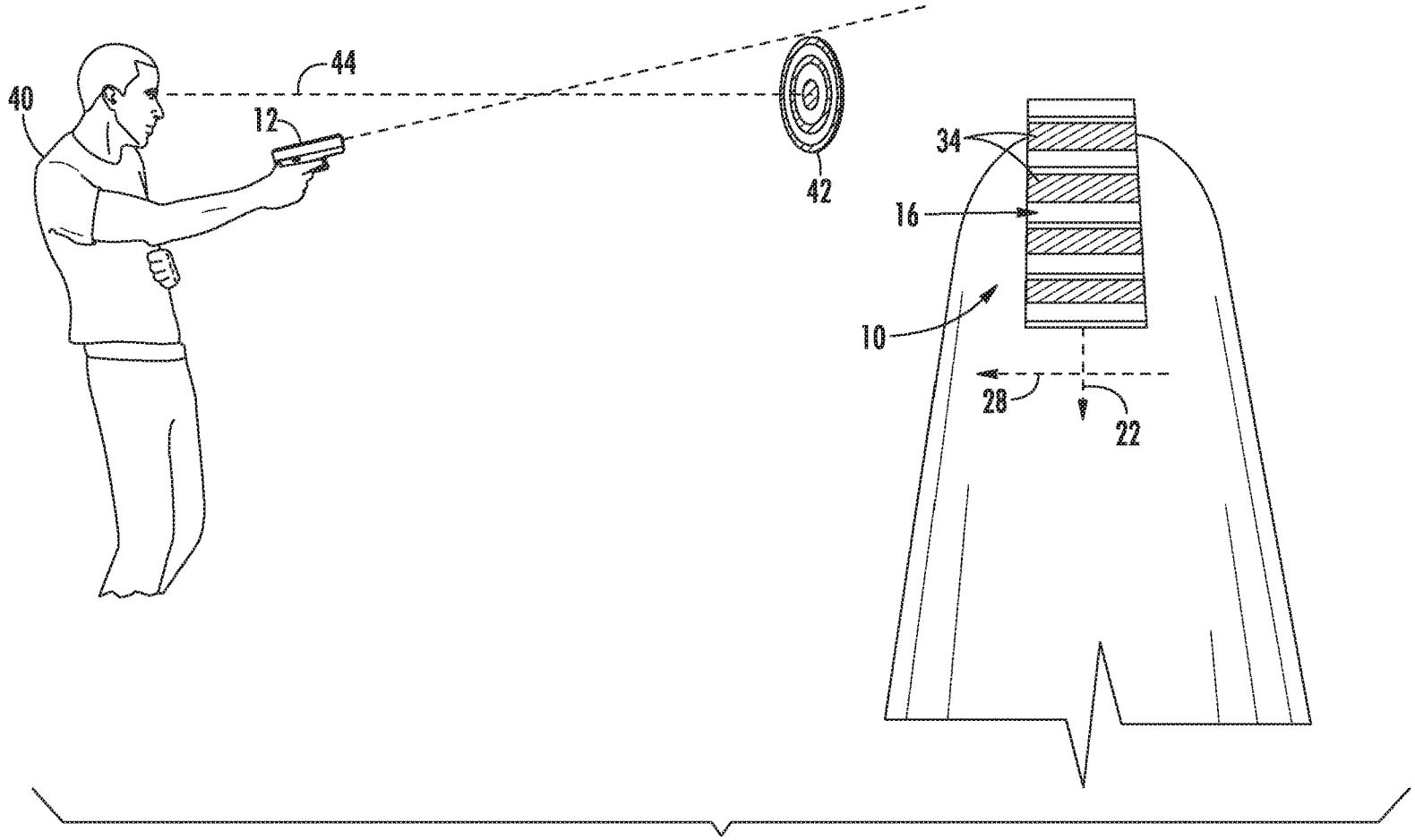
FIG. 12 illustrates the embodiment shown in FIGS. 10-11 being aimed too high at a target.
Figure 13:
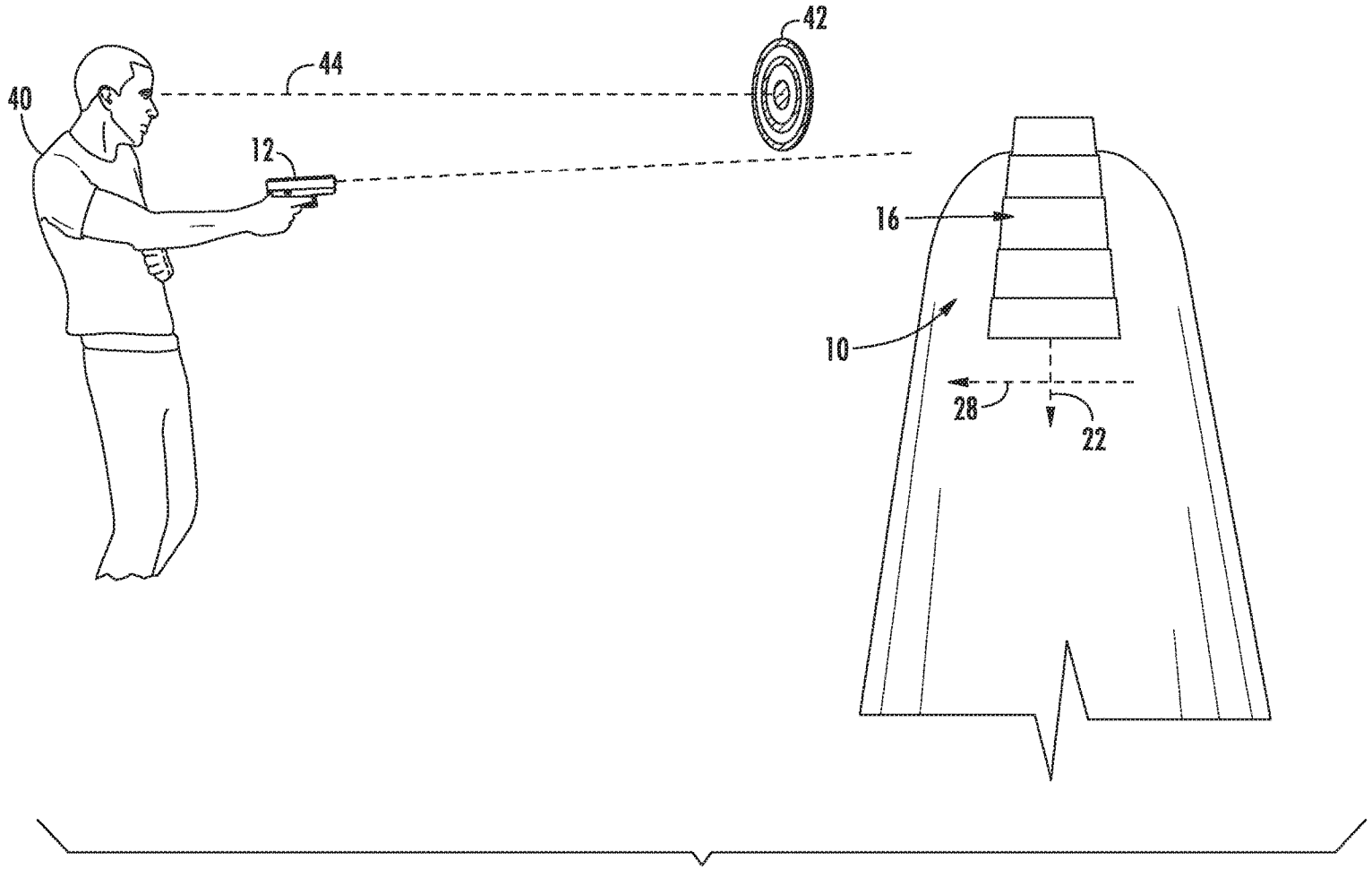
FIG. 13 illustrates the embodiment shown in FIGS. 10-11 being aimed too low at a target.
Figure 14:
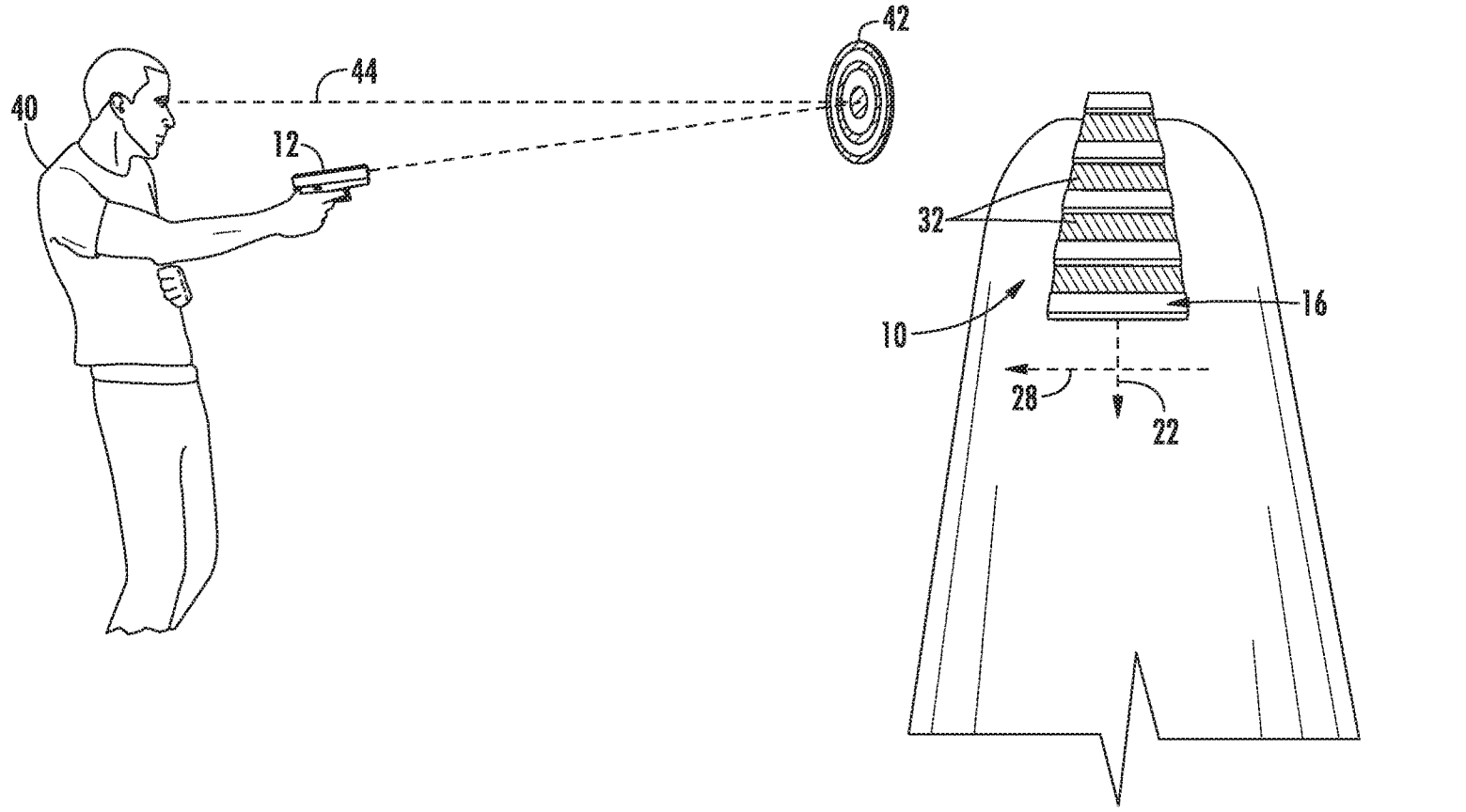
FIG. 14 illustrates the embodiment shown in FIGS. 10-11 being aimed correctly at a target.

FIGS. 12-14 illustrate the use of the alignment aid 10 shown in FIGS. 10 and 11. As shown on the left side of each figure, an operator 40 extends the object 12 away from the operator 40 and toward a target 42 at an elevation slightly below the line of sight 44 from the operator 40 to the target 42. In this position, the alignment aid 10 is between the operator 40 and the target 42 and slightly below the line of sight 44 between the operator 40 and the target 42. As a result, the operator 40 is able to directly view the target 42 while also being able to peripherally view the alignment aid 10 from the right end of the first axis 22 as shown in FIGS. 10 and 11. From this axial perspective of the alignment aid 10, the operator 40 may conveniently and reliably determine if the object 12 is accurately pointed at the target 42 based on the appearance of the references 20, as shown on the right side of FIGS. 12-14.

If the operator 40 is aiming the object 12 too high, as shown on the left side of FIG. 12, then the second alignment features 34 closer to the operator 40 will appear narrower and closer together than the second alignment features 34 further from the operator 40, as shown on the right side of FIG. 12. If the operator 40 is aiming the object 12 too low, as shown on the left side of FIG. 13, then the first alignment features 32 or planar surface 16 will eclipse or hide the second alignment features 34 from view, as shown on the right side of FIG. 13. If the operator 40 is aiming the object 12 correctly at the target 42, as shown in the left side of FIG. 14, then each second alignment feature 34 will be readily visible and will appear to have a consistent length 24, width 26, and spacing 30 due to the vanishing property of perspective optical illusion, as shown on the right side of FIG. 14. In this manner, the alignment aid 10 provides the operator 40 with a convenient and reliable aid to quickly and accurately aim the object 12 at the target 42.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An alignment aid for an object having a longitudinal axis and a line of sight to a target, the alignment aid comprising:

a surface that defines a plane;

first, second, and third references aligned along a first axis of said surface, wherein each reference has a length along said first axis and a width along a second axis orthogonal to said first axis;

a distance between adjacent references along said first axis;

each reference comprises a first alignment feature adjacent to a second alignment feature;

each first alignment feature has a first alignment feature elevation orthogonal to said first and second axes;

each second alignment feature has a second alignment feature elevation orthogonal to said first and second axes;

for each reference, said first alignment feature elevation is higher than said second alignment feature elevation;

for each reference, along the line of sight to the target, said first alignment feature is closer to an operator along said first axis than said second alignment feature; and said first axis is aligned parallel with the longitudinal axis of the object.

2. The alignment aid as in claim 1, wherein each of said second alignment features extends vertically above said surface.

3. The alignment aid as in claim 1, wherein each of said second alignment features comprises a depression in said surface.

4. The alignment aid as in claim 1, wherein each of said second alignment features optically contrasts with each of said first alignment features.

5. The alignment aid as in claim 1, wherein said length of each reference increases along said first axis.

6. The alignment aid as in claim 1, wherein said width of each reference increases along said first axis.

7. The alignment aid as in claim 1, wherein said distance between adjacent references increases along said first axis.

8. The alignment aid as in claim 1, wherein at least one of said length, said width, or said distance between adjacent references progressively increases along said first axis.

9. An alignment aid for an object having a longitudinal axis and a line of sight to a target, the alignment aid comprising:

a surface that defines a plane;

first, second, and third references aligned along a first axis of said surface, wherein each reference has a length along said first axis and a width along a second axis orthogonal to said first axis;

a distance between adjacent references along said first axis;

each reference comprises a first projection adjacent to a second projection;

each first projection has a first projection elevation orthogonal to said first and second axes;

each second projection has a second projection elevation orthogonal to said first and second axes;

for each reference, said first projection elevation is higher than said second projection elevation;

for each reference, along the line of sight to the target, said first projection is closer to an operator along said first axis than said second projection; and said first axis is aligned parallel with the longitudinal axis of the object.

10. The alignment aid as in claim 9, wherein each of said second projections optically contrasts with each of said first projections.

11. The alignment aid as in claim 9, wherein said length of each reference increases along said first axis.

12. The alignment aid as in claim 9, wherein said width of each reference increases along said first axis.

13. The alignment aid as in claim 9, wherein said distance between adjacent references increases along said first axis.

14. The alignment aid as in claim 9, wherein at least one of said length, said width, or said distance between adjacent references progressively increases along said first axis.

15. An alignment aid for an object having a longitudinal axis and a line of sight to a target, the alignment aid comprising:

first, second, and third references aligned along a first axis, wherein each reference has a length along said first axis and a width along a second axis orthogonal to said first axis;

a distance between adjacent references along said first axis;

each reference comprises a first alignment feature adjacent to a second alignment feature;

wherein said first alignment features define a planar surface and said second alignment features are below said planar surface;

for each reference, along the line of sight to the target, said first alignment feature is closer to an operator along said first axis than said second alignment feature; and said first axis is aligned parallel with the longitudinal axis of the object.

16. The alignment aid as in claim 15, wherein each of said second alignment features optically contrasts with each of said first alignment features.

17. The alignment aid as in claim 15, wherein said length of each reference increases along said first axis.

18. The alignment aid as in claim 15, wherein said width of each reference increases along said first axis.

19. The alignment aid as in claim 15, wherein said distance between adjacent references increases along said first axis.

20. The alignment aid as in claim 15, wherein at least one of said length, said width, or said distance between adjacent references progressively increases along said first axis.

* * * * *